US006050707A

United States Patent [19]

Kondo et al.

[11] Patent Number: 6,050,707

[45] Date of Patent: Apr. 18, 2000

[54] LIGHT EMITTING DIODE DEVICE

[75] Inventors: Toshiyuki Kondo, Funabashi; Yoshifumi Kawaguchi, Kawasaki; Takeo Itoh, Yokohama; Nobumichi Aita, Fujisawa, all of Japan

[73] Assignee: Stanley Electric Co., Ltd., Japan

[21] Appl. No.: 08/929,825

[22] Filed: Sep. 15, 1997

[51] Int. Cl.[7] ..... F21V 7/00

[52] U.S. Cl. ..... 362/346; 362/800; 362/308; 313/512

[58] Field of Search ..... 362/308, 343, 362/346, 800; 313/500, 510, 512; 257/98, 99, 100

[56] References Cited

U.S. PATENT DOCUMENTS 3,676,668 7/1972 Collins et al. ..... 313/512

FOREIGN PATENT DOCUMENTS 6846 1/1994 Japan .
66400 2/1994 Japan .
639464 10/1994 Japan .

*Primary Examiner*—Alan Cariaso
*Assistant Examiner*—Todd Reed Hopper
*Attorney, Agent, or Firm*—Gifford, Krass, Groh, Sprinkle, Anderson & Citkowski, P.C.

[57] ABSTRACT

An rectangularly shaped illumination area utilizing an LED device having a high utilization efficiency in light flux and having an economical manufacturing cost is attained. Herein a light flux emitted from an LED chip 1 and then reflected by reflective surfaces of a horn 11 toward a lens 12 is concentrated into corner FIGS. 14 located in diagonal directions of the rectangular shape 4 while another light flux emitted from the LED chip 1 and directly incident to the lens 12 is focused by the lens on an area having an elliptic FIG. 13, which is inscribed in the rectangle area 4.

9 Claims, 5 Drawing Sheets

LIGHT EMITTING DIODE DEVICE

BACKGROUND OF THE INVENTION

1. Field of the Invention

The present invention relates mainly to a light emitting diode (referred to as "LED" hereinafter) device and, more particularly, to one capable of illuminating an area having a rectangular shape in a high utilization efficiency of a light flux, which is used for such as a flat display LED device or a backlighting LED device in use for a liquid crystal display (referred to as "LCD" hereinafter) device.

2. Brief Description of the Prior Art

FIG. 5 is a perspective view showing a main constitution of a conventional LED lamp, wherein an LED chip 1 is die-bonded on a bottom surface of a horn 2 while a lens 3 is provided above them.

Afore-mentioned LED lamp is equipped with the horn 2 having a circular cone surface and with the lens 3 having a radius of curvature R on a lens surface. As can be seen from FIG. 5, a junction, which constitutes a light emitting center of the LED chip 1, is located on an origin "O" of a three-dimensional rectangular Cartesian coordinate. A main axis of an axial symmetry for the above-mentioned lens surface having the radius of curvature R is located on an X-axis of the rectangular coordinate system formed of X, Y and Z axes. By above-mentioned configuration, a flux of direct incident lights, which are emitted from the LED chip 1 to be incident into a rear surface of the lens 3, and a flux of reflective lights, which are reflected on an inner surface of the horn 2, are spreaded to luminous intensity distribution angles Theta 1 and Theta 2, respectively, and superposed to each other in an X-Y sectional plane of FIG. 6. Above-mentioned luminous intensity distributions are consequently rotated around the X-axis in an direction indicated by an curved arrow as shown in FIG. 6.

Accordingly, the area illuminated by the LED junction, which has a higher luminous intensity than a half value in luminous intensity, exhibits a circular form. Afore-mentioned half value in luminous intensity is defined herein as a luminous intensity that directivity characteristics of the LED exhibit at a half value in angle (referred to as "Theta ½"). The directivity characteristics mean herein a three-dimensional luminous intensity distribution of a light flux emitted from the LED junction, which is located on the origin "O" of the coordinate system. Further, afore-mentioned half value in angle is now defined as an inner angle between a direction, wherein the directivity characteristics take a most intensive value, and another direction, wherein the directivity characteristics take a 50% value of the most intensive value.

When a rectangularly shaped region of 1:2 in aspect ratio is illuminated by use of the conventional LED lamp having above-mentioned illumination characteristics, various sorts of configurations have been investigated to even the luminous intensity distribution up to now as shown in FIGS. 7A–7C.

A conventional constitution indicated in FIG. 7A is intended to enlarge the area illuminated with only one piece of LED device by increasing a distance from the LED device to the target area, which circumscribes a circular FIG. 5 of the luminous intensity distribution about a rectangle 4. Herein areas 6, which are hatched with slanting solid lines as shown in FIG. 7A. Represents a loss in flux of the distributed lights.

Another conventional configuration shown in FIG. 7B is intended to widen laterally the figure of the illuminated area by utilizing two pieces of LED lamps corresponding to the shape of the rectangle 4. On the other hand, a still another conventional configuration shown in FIG. 7C is an example, wherein two external optical components 7 such as so called "inner lenses" are auxiliarily equipped above the two LED devices. The illumination area 5 of the conventional example shown in FIG. 7C turns almost rectangular and the loss areas 6 in light flux are further shrinked.

However, when afore-mentioned LED lamps up-to-now are used for illuminating a rectangularly shaped target, they have involved problems that they can merely exhibit a poor utilization efficiency in light flux or, otherwise, their manufacturing costs require much expense.

Namely, the method shown in FIG. 7A has only a low utilization efficiency in light flux and is regarded as an ineffective technology. Although a transforming the external shape of the circular lens is transformed into an elliptic one in order to illuminate the area having an elliptic shape which circumscribes about the rectangularly shaped illumination area improves a little the utilization efficiency, the loss in light flux stays still high.

On the other hand, though the structure shown in FIG. 7B exhibits a better utilization efficiency in light flux compared with the method shown in FIG. 7A, the manufacturing cost turns expensive because number of used LED devices increases. The structure shown in FIG. 7C further increases the utilization efficiency in light flux compared with the structure shown in FIG. 7B, but it raises further the manufacturing costs compared with that of FIG. 7B due to an increase in parts' number of the external optical system, which are auxiliarily equipped.

SUMMARY OF THE INVENTION

The present invention is carried out to solve the problems mentioned above. Namely, an object of the present invention is to provide an LED device in use for illuminating an area having a rectangular shape, which has a high utilization efficiency in light flux and simultaneously an economical manufacturing cost.

To satisfy above-mentioned purposes, the present invention is constituted as follows:

(1) An LED device for illuminating an area having a rectangularly shaped figure; comprising:

a horn, of which cross-sections parallel to a bottom surface of the horn are approximately quadrangles, having reflective surfaces, which reflect and concentrate lights emitted from an LED chip substantially into corners located in diagonal directions of the area having the rectangularly shaped figure to be illuminated; and a lens having an almost ellipsoidal surface, which focuses the light emitted from the LED chip on an almost elliptic area inscribing in the area having the rectangularly shaped figure.

(2) The LED device according to (1), wherein:

the ellipsoidal surface of the lens is an almost spheroid having a main axis parallel to a Z-axis of a three-dimensional rectangular coordinate system, of which origin is located substantially on a light emitting center of the LED chip.

(3) The LED devices according to (1) and (2), wherein:

the horn, of which quadrangular cross-sections parallel to the bottom surface of the horn are approximately rhombic-shaped, having reflective surfaces located in a symmetric configuration with respect to an X-axis of the three-dimensional rectangular coordinate.

(4) The LED devices according to (1), (2) and (3), wherein:

the reflective surfaces of the horn include curvatures having a corrective action for compensating a phenomenon of excessively focusing the reflected light, which the lens having either the ellipsoidal or the spheroidal surface may induce unless the corrective action is undertaken.

DETAILED DESCRIPTION OF THE PREFERRED EMBODIMENTS

Hereinafter described is the best mode of the present invention being carried out into practice corresponding to the preferred embodiments. Embodiments according to the present invention are detailed with reference to the drawings from FIG. 1 to FIG. 4A.

Figure 1:
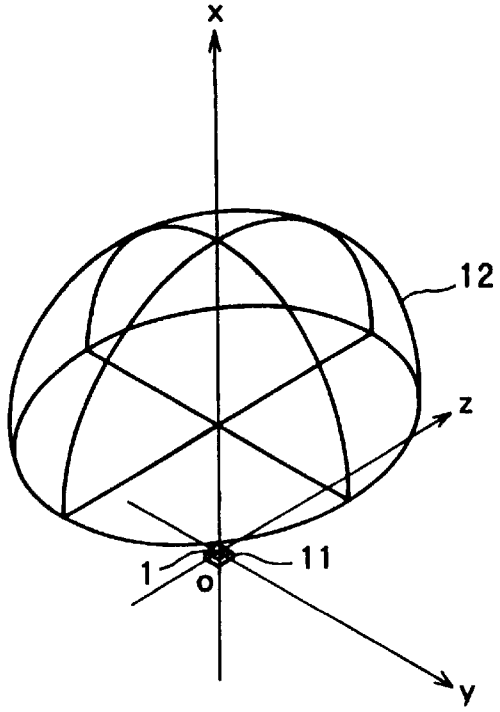
FIG. 1 is a schematic perspective view showing a constitution of embodiments according to the present invention.

FIG. 1 is a schematic perspective view showing a main constitution of an LED lamp (device) according to the present invention. In FIG. 1, an LED chip is denoted by 1 in numeral symbol meanwhile reflective surfaces of a horn having quadrilateral cross-sections which concentrates lights emitted from the LED cell 1 into four corner figures located on two diagonal directions of a rectangular area is denoted by 11. A lens having an ellipsoidal surface, which focuses the lights emitted from the LED chip 1 into an elliptic area inscribing in afore-mentioned rectangle is denoted by 12.

Figure 2:
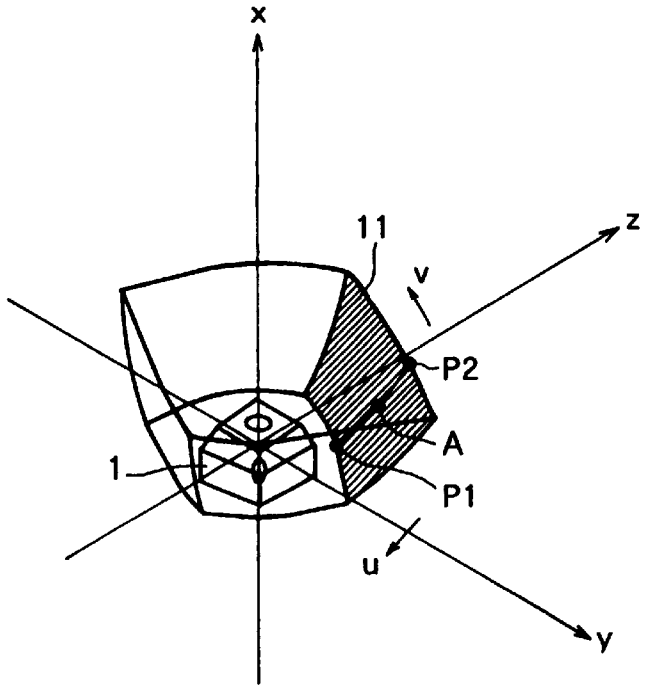
FIG. 2 is a schematic perspective view illustrating a configuration of a horn shown in FIG. 1.

The ellipsoidal surface of above-mentioned lens 12 is preferably a spheroid, of which main axis is a straight line parallel to a Z-axis of a rectangular three-dimensional coordinate having a junction, namely, a light emission center as an origin "O" of the coordinate. The reflective surfaces of the horn 11 having the approximately quadranglar cross-sections have preferably rhombic shapes, which are symmetric with respect to the X-axis of the coordinate including a junction plane of the LED chip substantially within a Y-Z plane as shown in FIG. 2.

Figure 5:
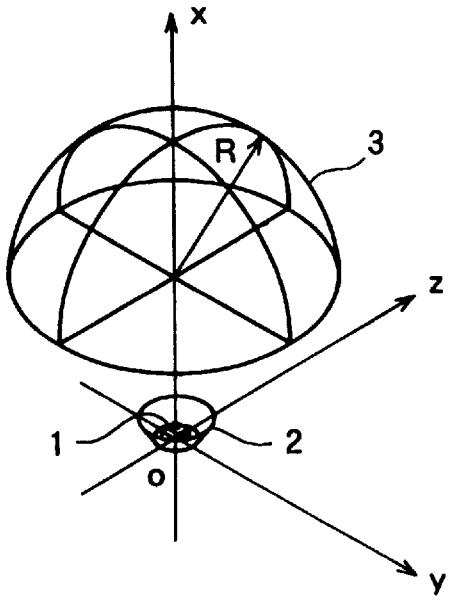
FIG. 5 is a perspective view showing a constitution of a conventional LED lamp.
Figure 6:
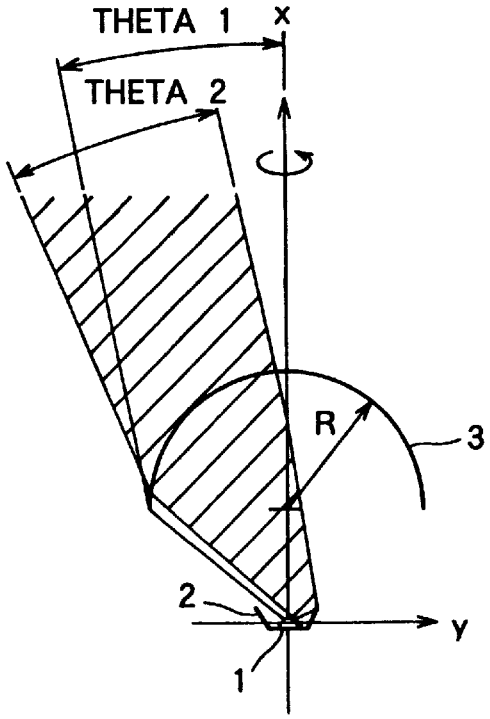
FIG. 6 is a schematic view illustrating luminous intensity distributions of a conventional LED lamp.

The LED lamp constituted mentioned above is suitable for illuminating the area having the rectangular shape with a high utilization efficiency in light flux, which is composed of only one LED chip and of only one horn similarly as the conventional one shown in FIG. 5 so that the present invention simultaneously satisfies a requirement of economical manufacturing cost.

When the LED chip 1 is located so that the junction center coincides with the origin "O" of the coordinate and the junction plane is located within the Y-Z plane, the lens surface constituting the spheroid is obtained by Equation (1):

$$x^2+y^2+0.6865\,Z^2-4.72\,x-2.8404=0 \qquad (1).$$

Herein three-dimensional coordinates: x, y and z indicate the coordinates of any points located on the lens surface constituting the spheroid, of which main axis is the straight line parallel to the Z-axis.

Figure 3A:
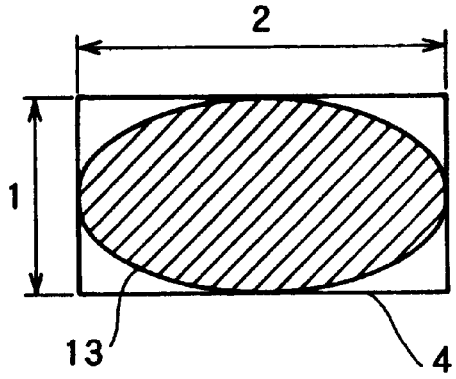
FIG. 3A is computer-aided simulation data of an area illuminated by light emitted from an LED chip and focused utilizing a lens according to the embodiments.

The lens surface defined in Equation (1) mentioned above focuses the light flux emitted from the LED chip located on the origin "O" of the coordinate system on the illuminated area 13 having the elliptic figure, which inscribed in the rectanglar area 4 as shown in FIG. 3A, for instance, being 16.5 mm apart from the origin "O" and having an area of 12 by 23 mm (approximately 1:2 in aspect ratio). The illuminated area 13 having the elliptic figure is obtained by plotting points utilizing a curve-plotter, which have more intensive luminous intensities than afore-mentioned half value in intensity.

The horn surfaces having the approximately rhombic-shaped cross-sections are symmetric with respect to the X-axis. One surface of the horn 11, which is hatched with slanting solid lines as shown in FIG. 2, is obtained by an equation including first power terms of u and from first to fifth power terms of v, namely an equation of fifth degree, if u and v are employed as parameters having values between null and unity. Coordinates (x, y, z) of any points existing on the curvature of the horn are derived from Equation (2), wherein AX (i), AY (i) and AZ (i) are employed as constants in Equation (2) and tabulated in Table 1.

TABLE 1

| i | AX (i) | AY (i) | AZ (i) |
|---|---|---|---|
| 1 | 0.49 | 0.94 | 0 |
| 2 | −0.6 | −0.434 | 0 |
| 3 | 0 | −0.571 | 0.545 |
| 4 | 0 | 0.381 | −0.125 |
| 5 | 0 | −0.018 | −0.019 |
| 6 | 0 | −0.095 | −0.040 |
| 7 | 0 | 0.084 | 0.091 |
| 8 | 0 | −0.088 | −0.096 |
| 9 | 0 | −0.098 | −0.108 |
| 10 | 0 | 0.119 | 0.089 |
| 11 | 0 | 0.025 | 0.027 |
| 12 | 0 | −0.033 | −0.019 |

$$\begin{vmatrix} x \\ \\ y \\ \\ z \end{vmatrix} = \begin{vmatrix} AX(1)+AX(2)u+AX(3)v+AX(4)vu+AX(5)v^2+ \\ AX(6)v^2u+AX(7)v^3+AX(8)v^3u+AX(9)v^4+AX(10)v^4u+ \\ AX(11)v^5+AX(12)v^5u \\ \\ AY(1)+AY(2)u+AY(3)v+AY(4)vu+AY(5)v^2+ \\ AY(6)v^2u+AY(7)v^3+AY(8)v^3u+AY(9)v^4+AY(10)v^4u+ \\ AY(11)v^5+AY(12)v^5u \\ \\ AZ(1)+AZ(2)u+AZ(3)v+AZ(4)vu+AZ(5)v^2+ \\ AZ(6)v^2u+AZ(7)v^3+AZ(8)v^3u+AZ(9)v^4+AZ(10)v^4u+ \\ AZ(11)v^5+AZ(12)v^5u \end{vmatrix} \quad (2)$$

Figure 3B:
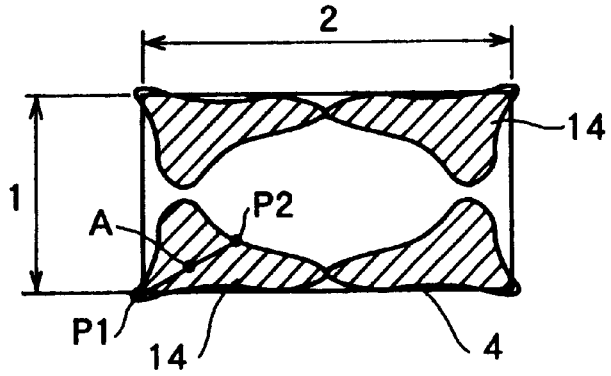
FIG. 3B is computer-aided simulation data of another areas illuminated by lights reflected on horn surfaces according to the embodiments.
Figure 3C:
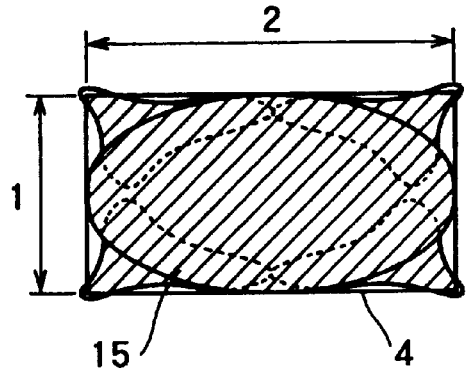
FIG. 3C is a superposition of data shown in FIGS.3A and 3B.

Equation (2) mentioned above indicates coordinates of the points located on the horn surfaces thereby to concentrate the reflected light into four triangularly shaped illumination areas, of which apices exist in the diagonal directions of the rectangular FIG. 4 having the area of 12 mm by 23 mm, as shown in FIG. 3B, and being located 16.5 mm apart from the origin "O" as shown in FIG. 3B. A point P1 on the apex of the triangularly illuminated area 14, another point P2 located internally on a base of the triangle and a line segment "A" located between P1 and P2 shown in FIG. 3B correspond to the points P1 and P2 together with the line segment "A" located on one of the horn surfaces hatched with slanting solid lines for reflecting the emitted light flux shown in FIG. 2. Their coordinates are expressed by Equation (2).

A superposition of the illumination FIG. 13 and the illumination FIGS. 14 produces an almost rectangular illumination FIG. 15. Namely, a combination of an elliptic illumination utilizing the spheroidal lens surface and of a concentrated reflection utilizing the horn surfaces toward the corner shapes located in diagonal directions attains a quite rectangularly shaped illumination.

Even a simple superposition of an illumination figure upon another illumination figure, which have been individually and independently designed and formed from each other, gives a fairly good coincidence with a measured luminous intensity distribution. Because Equation (2) includes corrective terms for compensating an excessively focusing action of the lens 12 with respect to the light fluxes reflected by the horn surfaces, a superposition of computer-aided simulation data shown in FIGS. 3A and 3B utilizing Equations (1) and (2) to obtain the data shown in FIG. 3C can give an almost optically measured value or an intrinsic value for the luminous intensity distribution data.

Figure 4A:
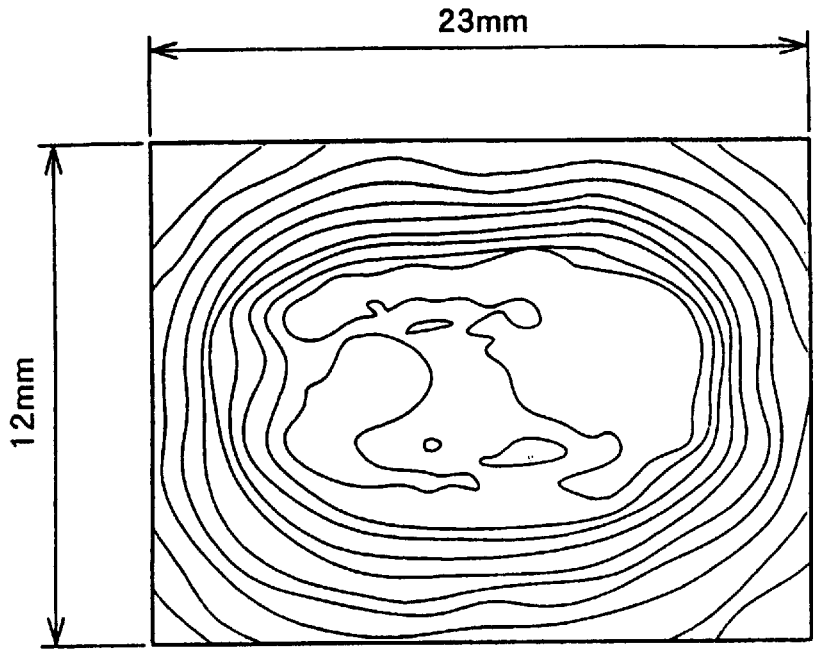
FIG. 4A is a computer-aided simulation data of a luminous intensity distribution according to the embodiments.
Figure 4B:
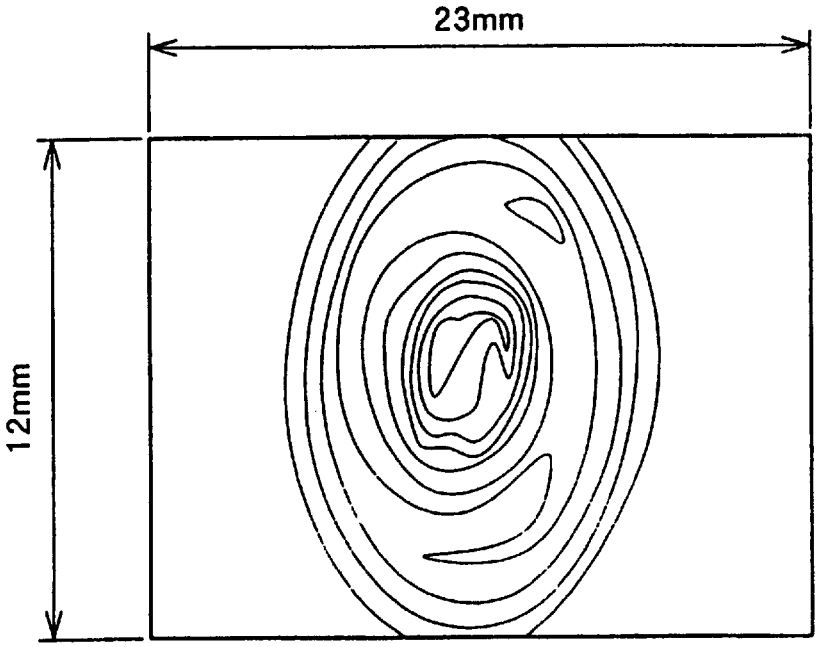
FIG. 4B is a computer-aided simulation data of another luminous intensity distribution of a conventional LED device.
Figure 7A:
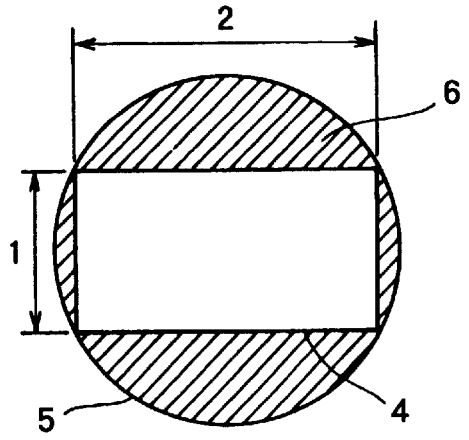
FIGS.7A to 7C are schematic views showing various configurations of conventional LED lamps in use for illuminating rectangular areas.
Figure 7B:
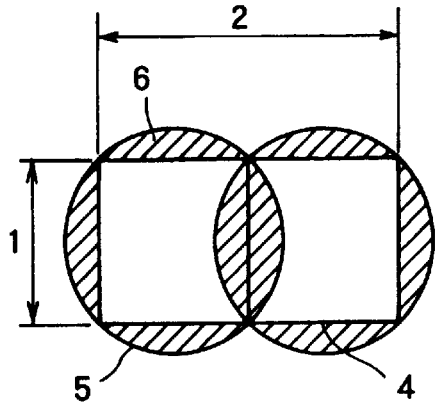
Figure 7C:
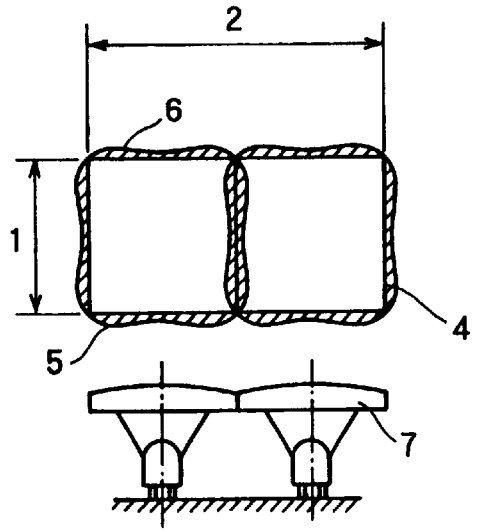

In FIGS. 4A and 4B, the luminous intensity distribution characteristics of the LED lamps are indicated, which are calculated by computer-aided simulations utilizing Equations (1) and (2). Herein FIG. 4A illustrates the luminous intensity distribution characteristics of the LED device according to the present invention as shown in FIGS. 1 to 3C. Meanwhile FIG. 4B displays that of the conventional example, which employs only one LED chip as a light source as shown in FIG. 7A similarly to the present invention. A comparison between FIGS. 4A and 4B clarifies that an illumination area having a higher luminous intensity than the half value in intensity in the rectangular shape 16.5 mm apart from the origin "O" according to the present invention is 2.3 times broader than that of the conventional LED lamp of FIG. 7A. It is no need to say that Equations (1) and (2) should be modified and simplified during the simulation of the luminous intensity characteristics shown in FIG. 4B of the conventional LED device shown in FIG. 7A.

A direct illumination of the rectangularly shaped area utilizing only one LED chip, which is devised in the present invention and configured as above, can improve the poor light flux utilization efficiency characteristic of the conventional devices. The direct illumination system for the rectangularly shaped are according to the present invention cannot only redce the number of the LED chips but also eliminates the needs for external optical systems such as inner lenses auxiliarily provided with LED lamp systems, which can accordingly reduce much of the manufacturing costs of LED illumination systems.

Beside the LED lamps in use for the rectangularly shaped flat display devices and in use for the backlighting of LCD devices mentioned before, the LED devices according to the present invention are also utilizable in LED illumination systems in use for low-cost/high-performance High-Mounting Stoplights (referred to as "HMSL") of cars having few LED chips without inner lenses and in use for outdoor information display devices.

What is claimed is:

1. An LED device for illuminating an area having a rectangular shape, said device comprising:

an LED chip for emitting light, said chip having a junction center and a junction plane;

a horn having a bottom surface and an inner surface for reflecting a portion of the light emitted from said chip, the inner surface having a generally quadrilateral cross section parallel to the bottom surface of the horn a lens disposed above said horn, said lens having a generally ellipsoidal upper surface.

2. The LED device according to claim 1, wherein said reflective inner surface of said horn includes curvatures which correct for excessive focusing of the reflected light, which said lens would induce without the correction due to said curvatures.

3. The LED device according to claim 2 wherein said generally ellipsoidal upper surface of said lens is generally spheroidal.

4. The LED device according to claim 2 wherein said generally quadrilateral cross section is generally rhombic.

5. The LED device according to claim 1, wherein said generally ellipsoidal upper surface of said lens is generally spheroidal.

6. The LED device according to claim 1, wherein the generally quadrilateral cross section is generally rhombic.

7. The LED device according to claim 1, wherein said junction plane is disposed in a Y-Z plane of a coordinate system and said junction center is disposed on the origin of the coordinate system, the coordinate system further having an X axis extending upwardly from the origin, the surface of the lens being defined by $$x^2+y^2+0.6865\ z^2-4.72\ x-2.8404=0.$$

8. The LED device according to claim 1, wherein said inner surface of said horn comprises four surfaces.

9. The LED device according to claim 7, wherein said junction plane is disposed in a Y-Z plane of a coordinate system and said junction center is disposed on the origin of the coordinate system, the coordinate system further having an X axis extending upwardly from the origin, said inner surface of said horn comprising of four surfaces one said surface being defined by the following set of equations, $$\begin{vmatrix} x \\ \\ \\ \\ y \\ \\ \\ \\ z \\ \\ \\ \end{vmatrix} = \begin{vmatrix} AX(1) + AX(2)u + AX(3)v + AX(4)vu + AX(5)v^2 + \\ AX(6)v^2u + AX(7)v^3 + AX(8)v^3u + AX(9)v^4 + AX(10)v^4u + \\ AX(11)v^5 + AX(12)v^5u \\ \\ AY(1) + AY(2)u + AY(3)v + AY(4)vu + AY(5)v^2 + \\ AY(6)v^2u + AY(7)v^3 + AY(8)v^3u + AY(9)v^4 + AY(10)v^4u + \\ AY(11)v^5 + AY(12)v^5u \\ \\ AZ(1) + AZ(2)u + AZ(3)v + AZ(4)vu + AZ(5)v^2 + \\ AZ(6)v^2u + AZ(7)v^3 + AZ(8)v^3u + AZ(9)v^4 + AZ(10)v^4u + \\ AZ(11)v^5 + AZ(12)v^5u \end{vmatrix} \quad (2)$$

wherein u and v AX(i), AY(i), and AZ(i) are constants as tabulated in the following table

| i | AX (i) | AY (i) | AZ (i) |
|---|---|---|---|
| 1 | 0.49 | 0.94 | 0 |
| 2 | −0.6 | −0.434 | 0 |
| 3 | 0 | −0.571 | 0.545 |
| 4 | 0 | 0.381 | −0.125 |
| 5 | 0 | −0.018 | −0.019 |
| 6 | 0 | −0.095 | −0.040 |
| 7 | 0 | 0.084 | 0.091 |
| 8 | 0 | −0.088 | −0.096 |
| 9 | 0 | −0.098 | −0.108 |
| 10 | 0 | 0.119 | 0.089 |
| 11 | 0 | 0.025 | 0.027 |
| 12 | 0 | −0.033 | −0.019. |

* * * * *